US005746426A

United States Patent [19]

Nakabayashi et al.

[11] Patent Number: 5,746,426

[45] Date of Patent: May 5, 1998

[54] FEEDING DEVICE HAVING A FEED ROLLER WITH A LOW COEFFICIENT PORTION

[75] Inventors: Yoshikazu Nakabayashi; Hiroshi Hadano, both of Toyohashi; Norikazu Okabe; Hideki Sendou, both of Toyokawa, all of Japan

[73] Assignee: Minolta Co., Ltd., Osaka, Japan

[21] Appl. No.: 807,198

[22] Filed: Feb. 27, 1997

Related U.S. Application Data

[63] Continuation of Ser. No. 359,545, Dec. 20, 1994, abandoned.

[30] Foreign Application Priority Data

Dec. 22, 1993 [JP] Japan ..... 5-324749

[51] Int. Cl.[6] ..... B65H 3/06

[52] U.S. Cl. ..... 271/119; 271/127; 271/162

[58] Field of Search ..... 271/109, 116, 271/117, 119, 120, 160, 162, 164, 126, 127

[56] References Cited

U.S. PATENT DOCUMENTS

| | | | |
|---|---|---|---|
| 4,032,136 | 6/1977 | Komaba et al. | 271/160 |
| 4,569,587 | 2/1986 | Miyoshi et al. | 271/160 X |
| 4,674,735 | 6/1987 | Du Bon et al. | 271/116 X |
| 4,685,792 | 8/1987 | Iseki et al. | 271/164 X |
| 5,139,252 | 8/1992 | Morita et al. | 271/162 X |
| 5,372,359 | 12/1994 | Miura et al. | 271/119 |

FOREIGN PATENT DOCUMENTS

| | | | |
|---|---|---|---|
| 4-44509 | 2/1988 | Japan . | |
| 185735 | 8/1988 | Japan | 271/119 |
| 158329 | 7/1991 | Japan | 271/119 |
| 162333 | 7/1991 | Japan | 271/119 |
| 85223 | 3/1992 | Japan | 271/119 |

*Primary Examiner*—Boris Milef

*Attorney, Agent, or Firm*—Burns, Doane, Swecker & Mathis, LLP

[57] ABSTRACT

A feeding device which feeds paper sheets accommodated in a paper supply tray detachable from a body of an image forming apparatus. Paper sheets stacked in the paper supply tray is induced to make pressure contact with a feed roller in conjunction with attachment of the paper supply tray to the body of the apparatus, and release the pressure contact between paper sheets and the feed roller in conjunction with detachment of the paper supply tray from the body of the apparatus. The feed roller has on an exterior surface at least one portion having a friction coefficient lower than the rest portion of the exterior surface, and is stopped its rotation in a state that the lower friction coefficient portion contacts with an uppermost paper sheet when paper feeding is completed, so as to prevent paper jams caused by shifting or deformation of the uppermost paper sheet during attachment or detachment of the paper supply tray to the body of the apparatus.

13 Claims, 10 Drawing Sheets

FEEDING DEVICE HAVING A FEED ROLLER WITH A LOW COEFFICIENT PORTION

This application is a continuation of application Ser. No. 08/359,545, filed Dec. 20, 1994, now abandoned.

BACKGROUND OF THE INVENTION

1. Field of the Invention

The present invention relates to a feeding device for use in image forming apparatus such as copiers, printers, facsimiles and the like, and more specifically relates to a feeding device in the form of a cassette or paper feed tray removably installable relative to an image forming apparatus.

2. Description of the Related Art

In a conventional image forming apparatus, the paper feed tray is easily removable from the main apparatus for paper replenishment, paper jam processing and the like. There are two installation/removal methods; one method installs and removes the tray in a direction along the transport direction of the copy paper, and another method installs and removes the tray in a direction perpendicular to the transport direction of the copy paper, said latter method recently becoming widely used due to handling advantages. Whatever method is used, pressure contact with the feed roller must be released when removing the paper tray, such that a device is provided to raise and lower a paper loading panel or a feed roller in connection with the installation/removal operation.

However, such disadvantages arise when utilizing the movement of a paper tray during installation/removal of the tray to mechanically move the feed roller or paper loading panel, as shifting or deformation of the uppermost sheet of paper when papers contact with or separate from the feed roller. Particularly in devices in which a feeding tray is removably installed in a direction perpendicular to the paper transport direction, paper jams occur during installation, due to shifting of the paper in a direction perpendicular to the paper transport direction.

OBJECTIONS AND SUMMARY

A main object of the present invention is to provide a device which does not deform or shift papers on a paper tray when said tray is installed or removed.

Another object of the present invention is, in a device for removably installing a paper tray in a direction perpendicular to the paper transport direction, to prevent paper jam caused by sifting the paper tray in the installation/removal direction.

These and other objects of the present invention are achieved by providing a feeding device which feeds paper sheets accommodated in a paper supply tray detachable from a body of an image forming apparatus, comprising a feed roller having on an exterior surface at least one portion having a friction coefficient lower than the rest portion of the exterior surface, a pressure contact mechanism which induces paper sheets stacked in the paper supply tray to make pressure contact with said feed roller, and stop means for stopping rotation of said feed roller in a state that said lower friction coefficient portion of the exterior surface of said feed roller contacts with an uppermost paper sheet at least whenever said paper tray is removed from the body of the image forming apparatus.

These and other objects, advantages and features of the invention will become apparent from the following description thereof taken in conjunction with the accompanying drawings which illustrate specific embodiments of the invention.

BRIEF DESCRIPTION OF THE DRAWINGS

In the following description, like parts are designated by like reference numbers throughout the several drawings.

DETAILED DESCRIPTION OF THE PREFERRED EMBODIMENTS

The preferred embodiments of the present invention are described hereinafter with reference to the accompanying drawings.

Figure 1:
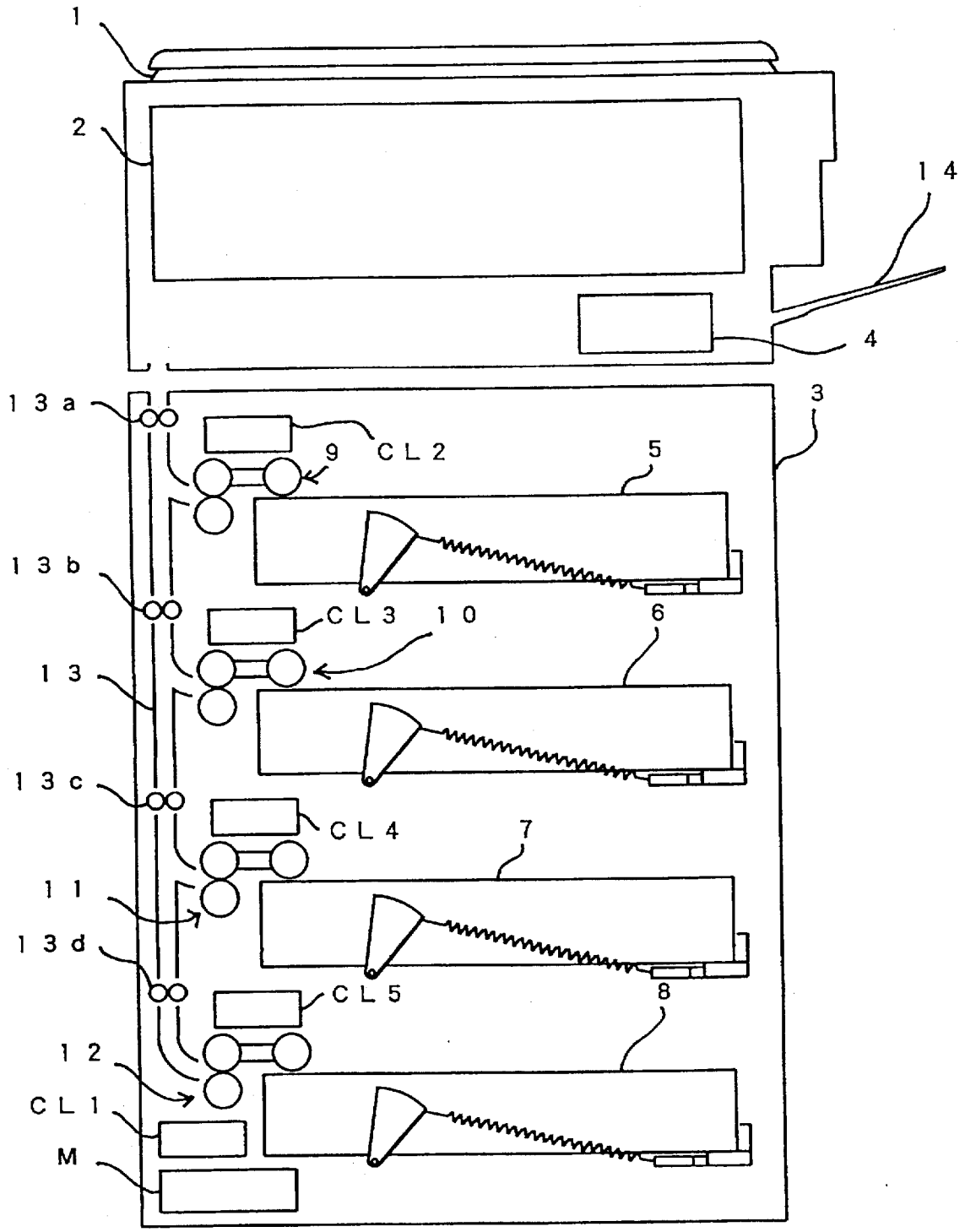
FIG. 1 is a section view showing the general construction of an embodiment of a copying apparatus of the present invention.

FIG. 1 is a section view showing the construction of a copying apparatus related to the present invention. The copying apparatus comprises image forming section 2 for forming on a copy sheet an image of an original document disposed on document platen 1, paper supply cabinet 3 for accommodating various copy paper to be transported to said image forming section 2, and control section 4 for controlling the aforesaid image forming section 2 and paper supply section 3.

Paper supply Section 3 is provided with four levels of paper feed trays 5, 6, 7, and 8 in vertical arrangement, and feed devices 9, 10, 11, and 12 respectively provided for each of said feed trays. Transport path 13 for receiving paper fed by each feeding device and transporting said sheets to image forming section 2 is provided at the side of the aforesaid feed trays 5, 6, 7, and 8, and said transport path 13 is provided with a plurality of pairs of transport rollers 13*a*, 13*b*, 13*c*, and 13*d*. The aforesaid pairs of transport rollers are driven by drive motor M via electromagnetic clutch CL1, the drive force of drive motor M being transmitted to the various feeding devices via a drive transmission mechanism not shown in the drawing, and ON/OFF switching is controlled by electromagnetic clutches CL2, CL3, CL4, or CL5 provided in each feeding device. Paper stacked in the respective feed trays is fed by feeding devices 9, 10, 11 or 12 in accordance with control signals from control section 4, so as to be sequentially transported via transport roller pairs 13*a*~13*d* to image forming section 2, and, following image formation, is output to discharge tray 14.

Feed trays 5, 6, 7, and 8 are supported so as to be removably pulled out in a direction perpendicular to the paper transport direction (foreground direction in the drawing) so as to accomplish paper resupply and clearing of paper jams, and are constructed such that the paper accommodated within the tray is lowered in conjunction with said pulling operation. Although the following description is given in terms of feed tray 5, it is to be understood that the other feed trays have identical constructions.

Figure 2:
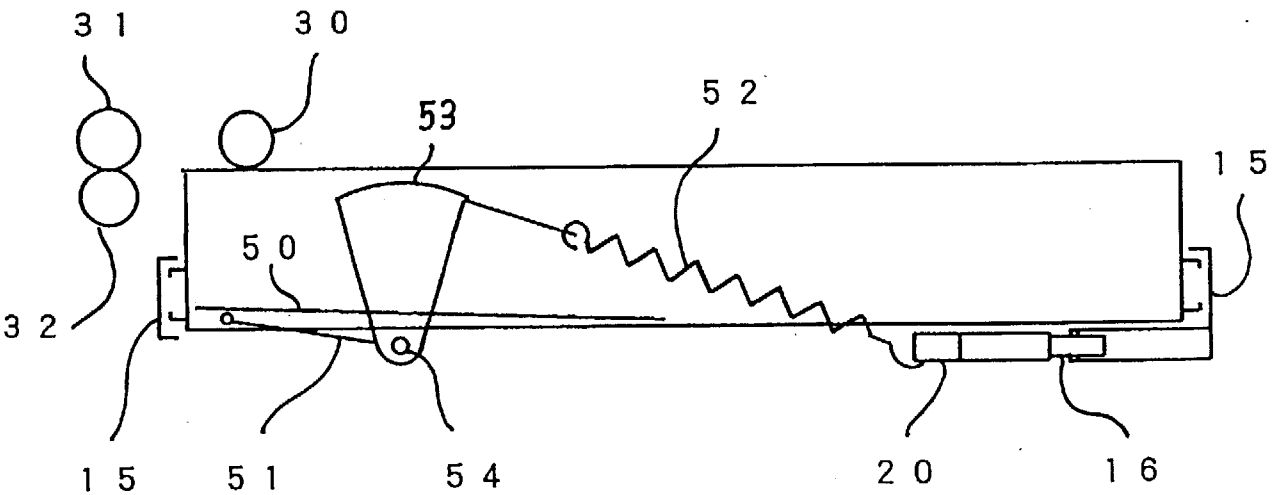
FIG. 2 is a side view showing the construction of a feed tray of the present embodiment.
Figure 3:
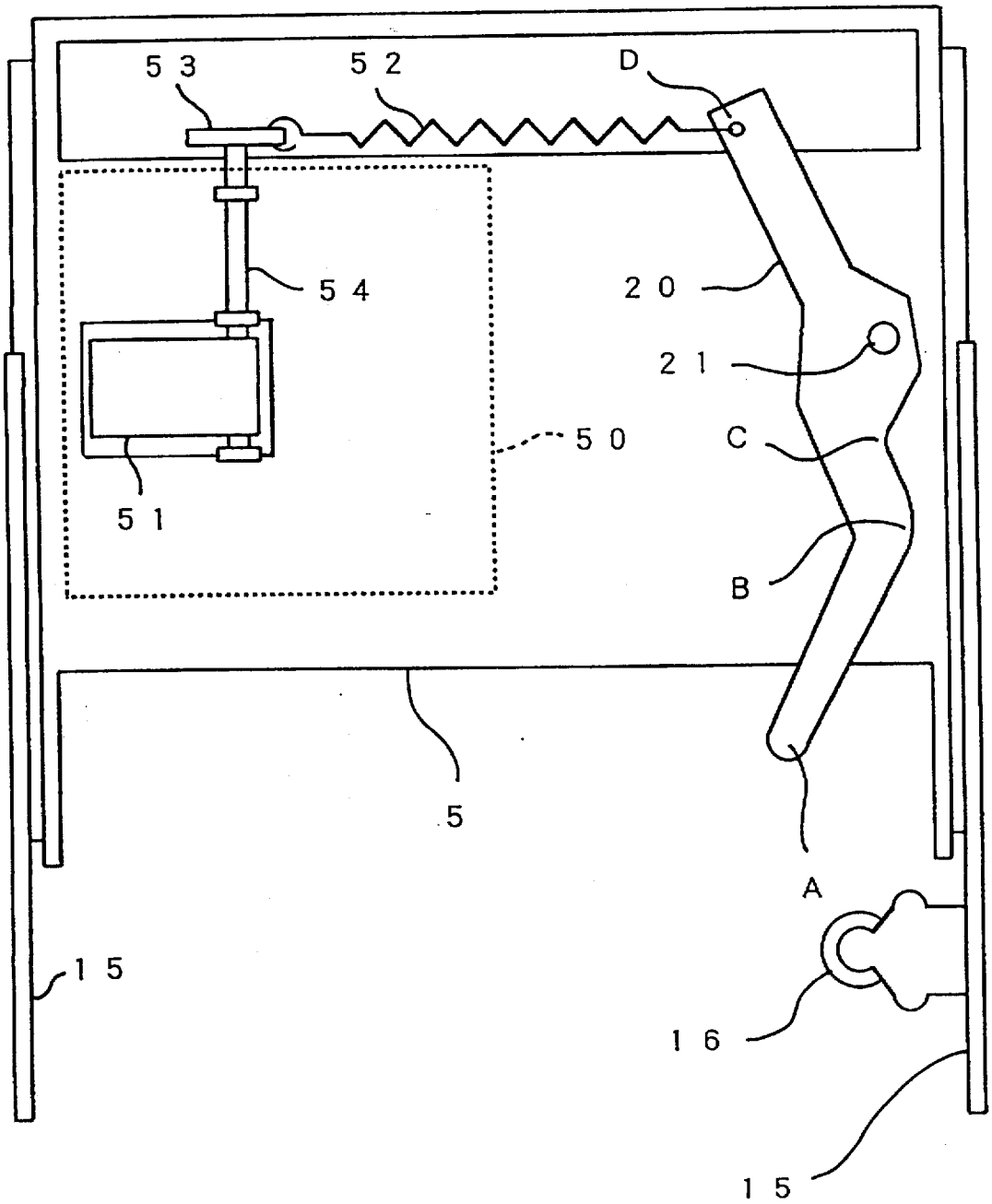
FIG. 3 is a rear view showing the paper sheet lifting device of the feed tray of the present embodiment.

FIGS. 2 and 3 show the construction of the feed tray. FIG. 2 is a side view, and FIG. 3 is an illustration viewed from below the feed tray when the feed tray is pulled out. Feed tray 5 is slidably supported by guide rail 15 provided on cabinet 3, and a paper loading panel 50 is provided within said tray 5 to support the copy sheets. Lifting member 51 for lifting paper loading panel 50 is provided at the bottom of feed tray 5; one end of said lifting member 51 is integratedly formed with rotating shaft 54 and fan-shaped retaining member 53 connected to spring 52. When spring 52 is in a nonforce-exerting state, lifting member 51 is lowered due to the weight of paper loading panel 50 (includes the weight of the paper when paper is loading thereon), i.e., the state shown in FIG. 2. When the force of spring 52 is exerted rightward in the drawing via the action of cam 20 which is described later, retaining member 53 is rotated about shaft 54 in a clockwise direction, such that lifting member 51 is simultaneously rotated in a clockwise direction. As a result, lifting member 51 is raised against the weight of paper loading panel 50 (includes the weight of the paper when paper is loading thereon), such that the uppermost sheet of paper is brought into contact with feed roller 30 of feed device 9 which is described later, whereupon said feed roller 30 is stopped in a slightly raised state. At this time, paper can be fed at a predetermined feed pressure.

On the other hand, cam 20 is provided so as to be oscillatable about pivot 21 on the bottom surface of removable feed tray 5, and roller 16 is provided on the interior wall of cabinet 3 so as to engage said cam 20. Point D at one end of cam 20 is connected to one end of spring 52, such that point D at one end of cam 20 connected to spring 52 is displaced via the contact of the cam surface of cam 20 with roller 16 whenever feed tray 5 is installed or removed along guide rail 15 provided within cabinet 3. The tension of spring 52 is switchable between a application state and non-application state relative to lifting member 51 via the previously described displacement.

The operation of raising paper loading panel 50 via cam 20 is described hereinafter with reference to FIG. 4.

Figure 4:
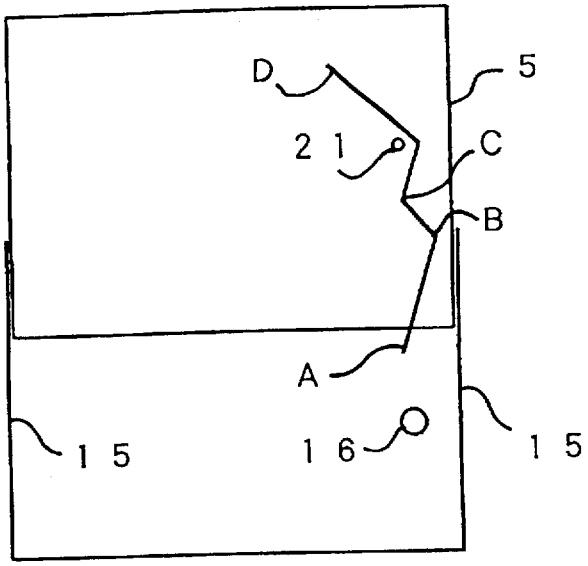
FIGS. 4*a*–4*d* are an illustration showing the operation of the paper sheet lifting device of the feed tray of the present embodiment.
Figure 4:
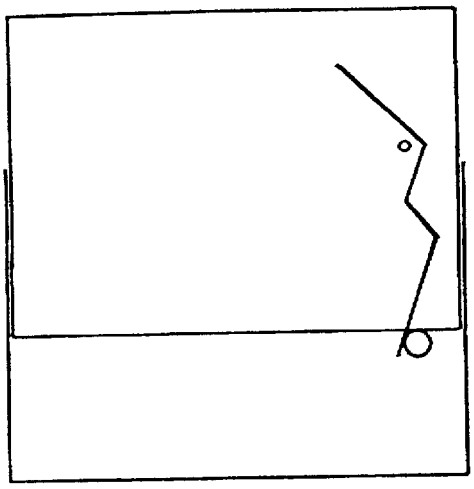
Figure 4:
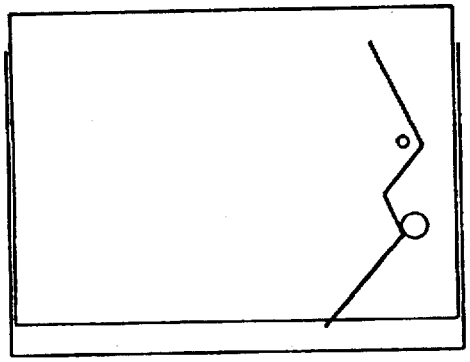
Figure 4:
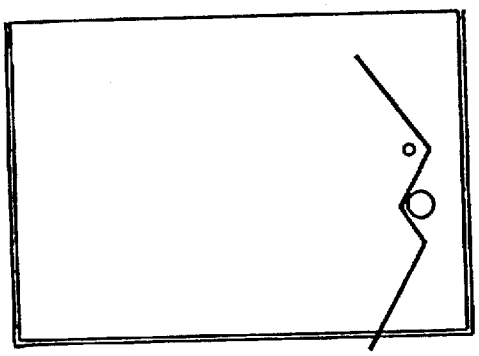

FIG. 4(*a*) shows the feed tray in the most removed state pulled out from cabinet 3. At this time, cam 20 is not in contact with roller 16. When feed tray 5 is installed, the leading edge A of cam 20 comes into contact with roller 16 (refer to FIG. 4(*b*)). When feed tray 5 is installed, the contact point of cam 20 and roller 16 moves along the cam surface, such that point D is moved rightward in the drawing, and spring 52 is extended to the right. In conjunction with the aforesaid action, lifting member 51 raises paper loading panel 50 and the paper (FIG. 4(*c*)).

When the contact point exceeds point B, cam point D is returned slightly to the left in the drawing, such that the tension force is somewhat relaxed. The situation is stable with point C (indentation of the cam surface) in a state of contact with roller 16 (FIG. 4(*d*)). At this time, feed tray 5 is completely installed in cabinet 3, such that normal paper feeding operation is possible. When feed tray 5 is pulled from cabinet 3, the operation of cam 20 and roller 16 is identical but in reverse sequence.

Figure 5:
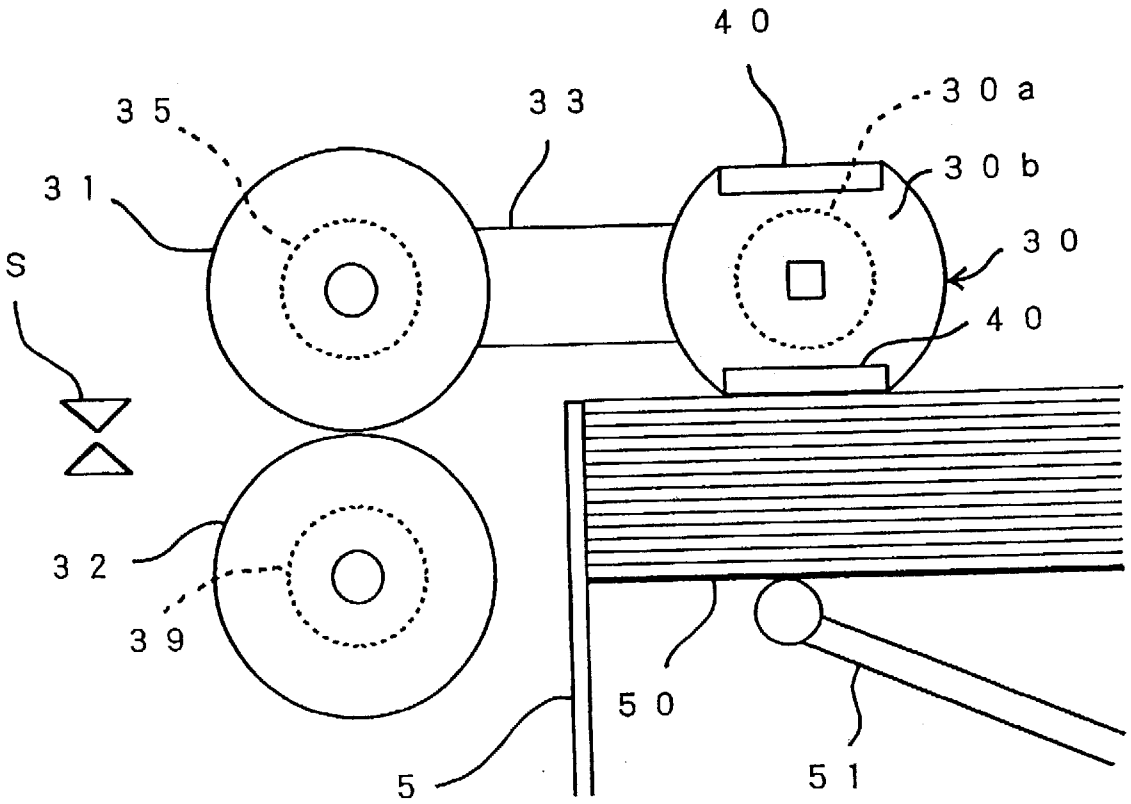
FIG. 5 is a side view showing the construction of the feeding section of the present embodiment.
Figure 6:
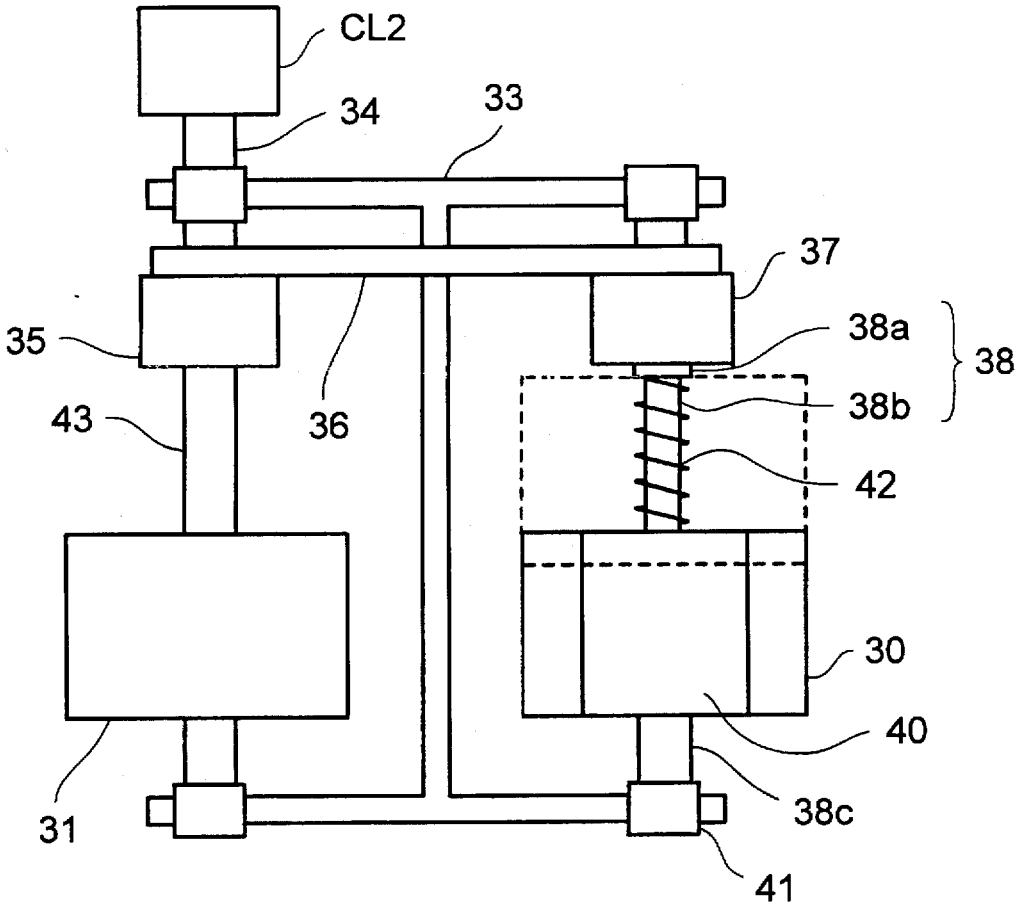
FIG. 6 is a top view showing the construction of the feeding section of the present embodiment.

The device for feeding paper sheet by sheet from feed tray 5 is described hereinafter with reference to FIGS. 5 and 6.

Feed device 9 is provided with feed roller 30 for feeding paper, and a pair of rollers comprising forward rotation roller 31 and reverse rotation roller 32 for separating paper sheets fed in overlapping state. Feed roller 30 is rotatably connected with shaft 43 of forward rotation roller 31 via frame 33. Drive shaft 34 of electromagnetic clutch CL2 is connected to shaft 43 of forward rotation roller 31 via one-way clutch 35, and is connected to shaft 38 of feed roller 30 via belt 36 and one-way clutch 37. one-way clutches 35 and 37 are arranged so as to permit rotation of forward rotation roller 31 and feed roller 30 in a clockwise direction in the drawing when drive shaft 34 is stationary. Drive shaft 34 is connected to the shaft of reverse rotation roller 32 via a torque limiter 39 and a belt not shown in the drawing. Torque limiter 39 transmits a drive force when a plurality of sheets are present between forward rotation roller 31 and reverse rotation roller 32, and does not transmit a drive force when a single sheet or no sheet is present therebetween.

Figure 7:
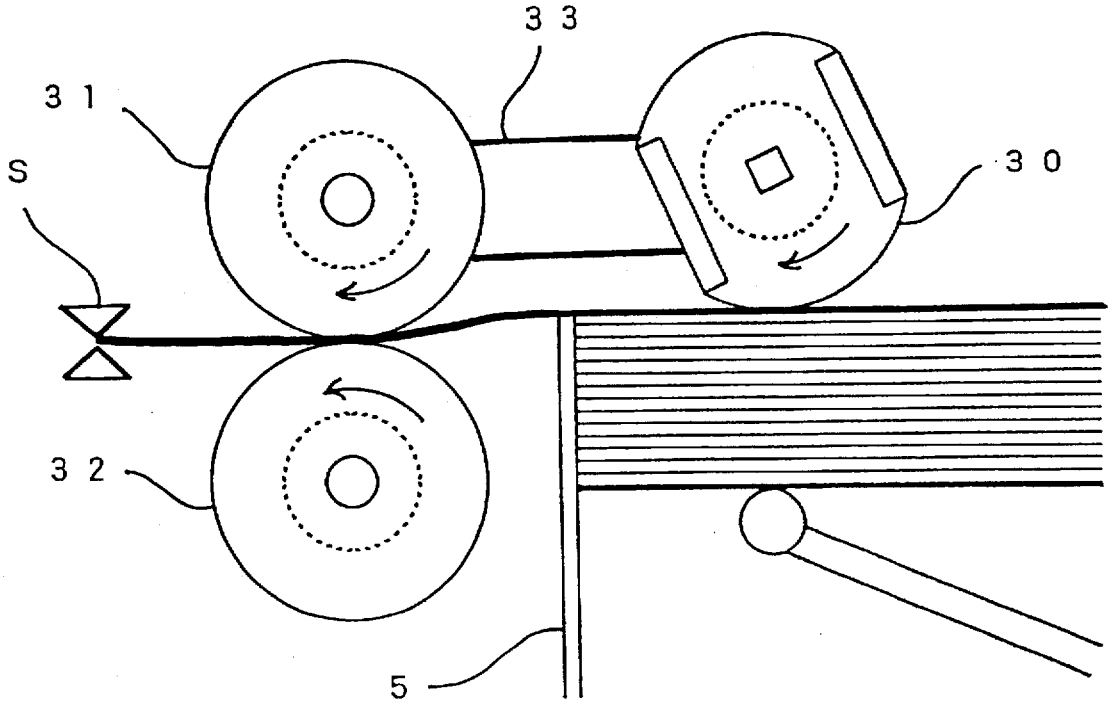
FIG. 7 is an illustration showing the operation of the feeding section of the present embodiment.
Figure 8:
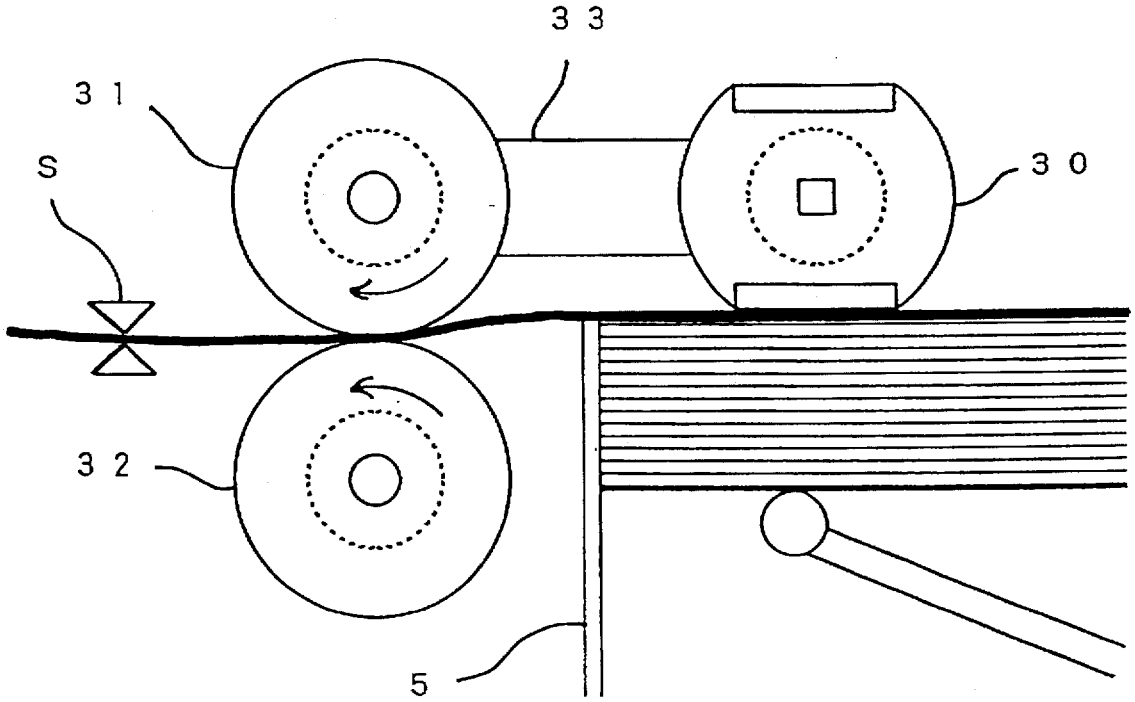
FIG. 8 is an illustration showing the operation of the feeding section of the present embodiment.

Feed roller 30 has a rubber roller portion 30*b* formed on the exterior circumference of a substrate portion 30*a* connected to shaft 38, and roller portion 30*b* is symmetrically notched at two locations relative to shaft 38, such that the surface of the roller at the notched portions accommodates flat low-friction member 40 (POM). The friction coefficient $\mu 1$ between low-friction member 40 and the uppermost sheet of paper is set so as to be less than the friction coefficient $\mu 2$ between two sheets of paper. Shaft 38 of feed roller 30 has cylindrical section 38*a* connected to one-way clutch 37, and cylindrical section 38*c* connected to bearing 41, and the section 38*b* formed therebetween is a rectangular rod shape with a square cross section, and a hole of feed roller 30 is formed to have a square cross section so as to match the shape of section 38*b*. Section 38*b* which is connected to feed roller 30 is formed by grinding the surface of a cylindrical shaft into a rectangular rod-like shape, such that the range of oscillation of feed roller 30 is regulated by the rectangular portion of shaft 38. Spring 42 is disposed between one-way clutch 37 of shaft 38 and feed roller 30, such that feed roller 30 is movable from the solid line position in the drawing during feeding operations via the action of spring 42 to the dashed line position when an external force is applied thereto. Paper feed sensor S is provided immediately downstream from forward rotation roller 31 and reverse rotation roller 32 to detect the paper transport condition. Control of the actuation of the feeding device having the previously described construction is described hereinafter with reference to the operation illustrations of FIGS. 7 and 8, and the timing chart of FIG. 9. The example used in the description pertains to two consecutively fed sheets of paper.

Control section 4 outputs control signals to the various components within the copying apparatus when an operator switches ON a start key not shown in the illustrations, thereby starting a copy operation.

Figure 9:
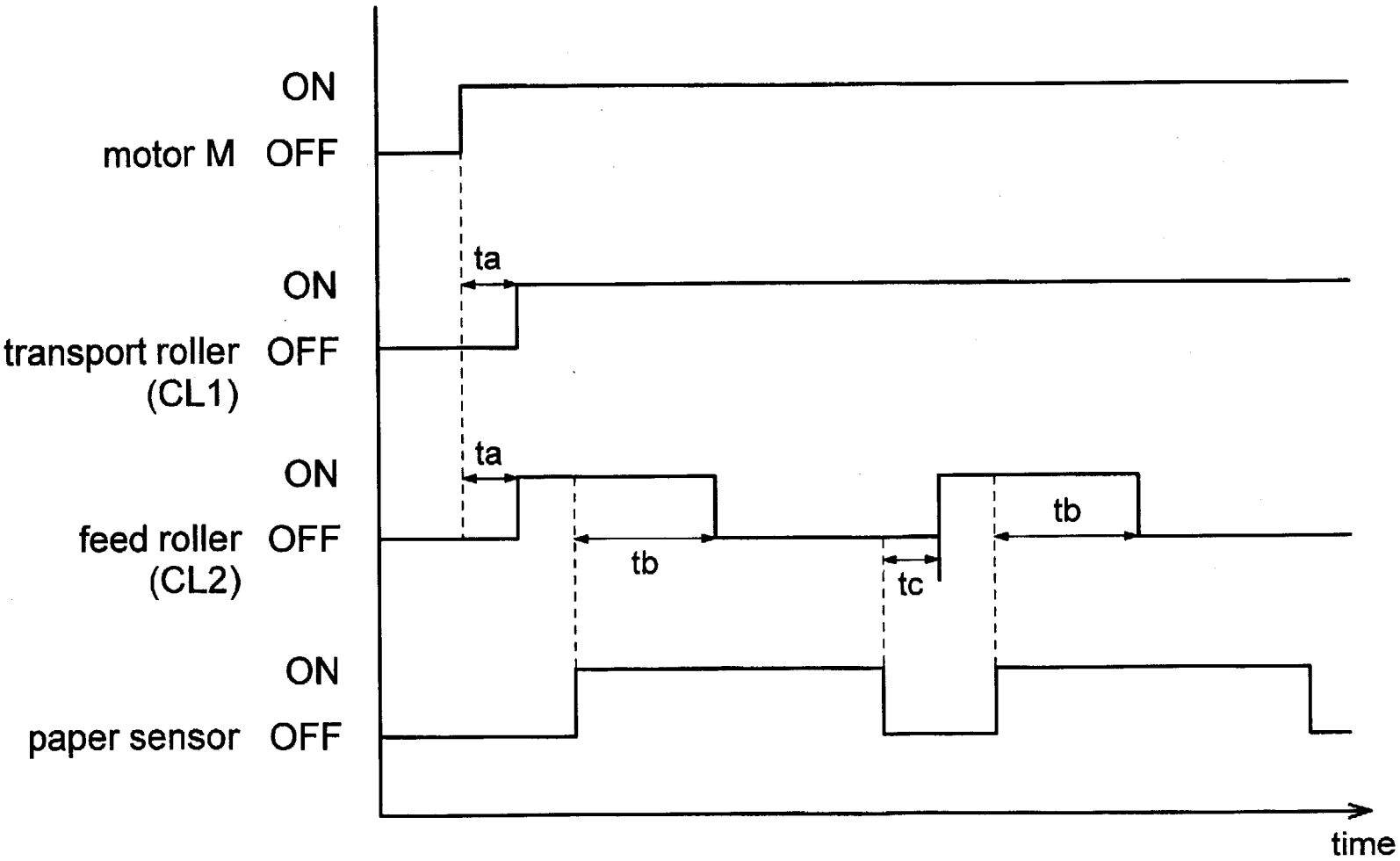
FIG. 9 is a timing chart showing the timing of the operation of the aforesaid feeding section.
Figure 10A:
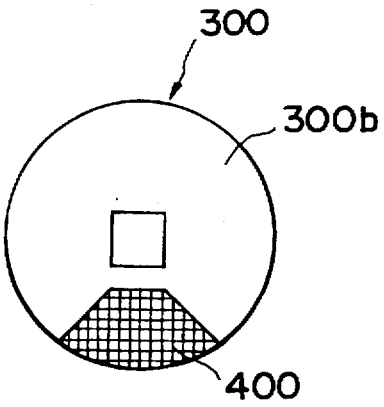
FIG. 10*a*–10*d* are an illustration showing a modification of the feed roller.
Figure 10B:
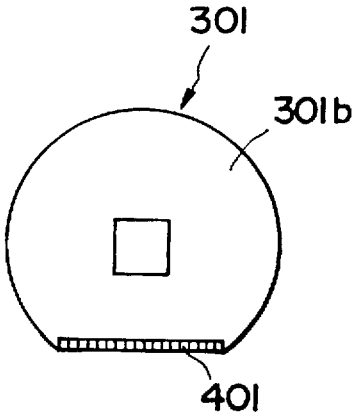
Figure 10C:
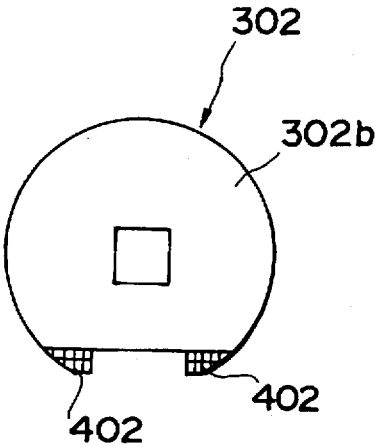
Figure 10D:
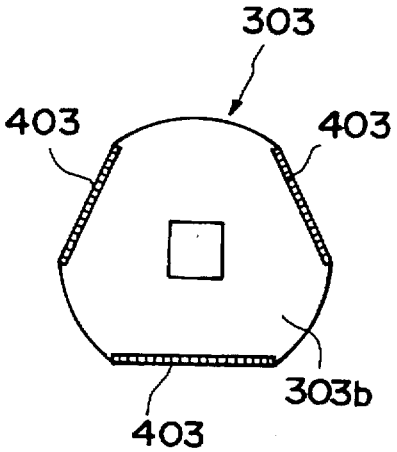

In FIG. 9, drive motor M is actuated by a signal transmitted from control section 4, and when a time ta has elapsed from the start of said actuation of drive motor M, clutch CL1 is switched ON. The pairs of transport rollers 13*a*~13*d* start to rotate when clutch CL1 is turned ON, and simultaneously therewith electromagnetic clutch CL2 is switched ON to rotate drive shaft 34. Feed roller 30, forward rotation roller 31, and reverse rotation roller 32 start to rotate in the arrow direction indicated in FIG. 7 in conjunction with the start of rotation by drive shaft 34, such that the uppermost sheet of paper stacked on paper loading panel 50 is fed via contact of said sheet with roller section 30*b* of feed roller 30. At this time, a next copy sheet transported with said uppermost sheet is prevented from moving by reverse rotation roller 32, such that only the uppermost copy sheet is transported between forward rotation roller 31 and reverse rotation roller 32 and transported by forward rotation roller 31 so as to pass paper sensor S and is gripped between the pair of transport rollers 13*a*.

When a time tb has elapsed after the leading edge of the paper is detected by sensor S, clutch CL2 is turned OFF, and feed roller 30, forward rotation roller 31, and reverse rotation roller 32 stop rotation. At this moment, since copy sheet has been already gripped and transported by pair of transport rollers 13*a*, feed roller 30, forward rotation roller 31, and reverse rotation roller 32 rotate following the transported copy sheet, and then feed roller 30 enters a state wherein low-friction member 40 is in contact with the top surface of the copy sheet in feed tray 5. Low-friction member 40 is both flat and has a lower friction coefficient relative to roller section 30*b*, such that in the aforesaid condition roller 30 is in a non-rotating stationary state. Thus, during transport, the copy sheet remains in contact with low-friction member 40 and slides smoothly therebelow, to complete the transport of a single sheet.

When a time tc has elapsed after sensor S has detected the trailing edge of a single copy sheet, clutch CL2 is switched ON to again start rotating feed roller 30, forward rotation roller 31, and reverse rotation roller 32 so as to feed a second copy sheet. Thereafter, the sequence is identical to that described for the first copy sheet.

As previously described, because feed roller 30 is normally stationary in a state wherein low-friction member 40 is in contact with the surface of an uppermost copy sheet. Accordingly, feed roller 30 slides relative to the surface of said copy sheet when feed tray 5 is pulled out, and said copy sheet is not shifted thereby. For example, even when the friction coefficient is increased such that the aforesaid slidability deteriorates due to paper particles adhering to low-friction member 40 or due to changes of said member 40 over time, the copy sheet is not shifted because feed roller 30 oscillates over shaft 38 with the movement of said copy sheet, and excellent paper feeding is achieved because feed roller 30 is returned to the original position by spring 42 with the lowering of the copy sheet. Since the uppermost copy sheet slides smoothly while in contact below the low-friction member 40 even when installing feed tray 5, the uppermost copy sheet is not wrinkled through said contact.

Feed roller 30 may be considered in various forms other than that previously described, such as those forms shown in FIG. 10. FIG. 10(*a*) shows a cylindrical feed roller 300 having a roller section 300*b* with a notched portion accommodating low-friction member 400, the surface of said low-friction member 400 being formed with a curvature identical to that of roller member 300*b*. FIG. 10(*b*) shows a cylindrical feed roller 301 having a roller section 301*b* with a notched portion accommodating low-friction sheet 401 adhered thereon. FIG. 10(*c*) shows a cylindrical feed roller 302 having a roller section 302*b* with flat notched portion accommodating low-friction members 402 only at the portion adjacent to the peripheral circumference of said roller section 302*b* so as to have a channel formed therebetween, such that the contact area is reduced to allow feed tray 5 to be pulled out smoothly. The aforesaid low-friction members may be provided at various locations on the circumference of the feed roller. FIG. 10(*d*) shows feed roller 303 having a roller section 303*b* notched at three locations to accommodate low-friction member 403.

Although the aforesaid embodiment has been described in terms of being removably installed in a direction perpendicular to the copy sheet transport direction of the feed tray, the present invention may also be applied to devices removably installed in a direction identical to the copy sheet feed direction. Further, the present invention is applicable to devices having feed rollers which are movable upward and downward in conjunction with removal of installation of a feed tray.

As a means for stopping the feed roller when the low-friction member is in a state of contact with the surface of a copy sheet, a pulse encoder may be provided on the same axis as the feed roller, such that actuation is normally turned OFF at the angle which the low-friction member contacts with the copy sheet surface in accordance with output from said pulse encoder.

The present invention provides a feeding device for transporting sheets from a feed tray which is removably installed relative to the body of an apparatus, and wherein a portion of the surface of a feed roller has a lower friction coefficient than other portions of said feed roller, such that the rotation of the feed roller is stopped with the aforesaid section of low-friction coefficient in a state of contact with the copy sheet surface at least when the feed tray is pulled from the apparatus body, thereby avoiding shifting and deformation of the sheet, and preventing paper jams and skewing of the sheet when the feed tray is installed and removed.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A feeding device which feeds paper sheets in an image forming apparatus, comprising:

a paper supply tray detachable from a body of the image forming apparatus;

a feed roller having an exterior surface, said exterior surface includes at least one flat shaped portion having a friction coefficient lower than a remaining portion of the exterior surface;

a pressure contact mechanism which induces paper sheets stacked in the paper supply tray to make pressure contact with said feed roller; and stop means for stopping rotation of said feed roller in a state that said lower friction coefficient flat shaped portion of the exterior surface of said feed roller contacts with an uppermost paper sheet at least whenever said paper tray is being removed from the body of the image forming apparatus.

2. The feeding device as claimed in claim 1 further comprising an interlocking mechanism which releases pressure contact between the paper sheets and the feed roller in conjunction with detachment or attachment of the paper supply tray to the body of the apparatus.

3. The feeding device as claimed in claim 2, wherein said interlocking mechanism comprises a cam mechanism which lifts the paper sheets in the paper supply tray in conjunction with attachment or detachment of the paper supply tray.

4. The feeding device as claimed in claim 1, wherein said paper supply tray is detachably attached to the body in a direction perpendicular to a paper transporting direction.

5. The feeding device as claimed in claim 4, wherein said feed roller is slidable in a direction in which the paper supply tray is drawn out of the body.

6. The feeding device as claimed in claim 1 further comprising a pair of paper transporting rollers on a downstream side of the feed roller so as to grip and transport a paper sheet fed by the feed roller, wherein said stop means includes a one way clutch which permits said feed roller to rotate in the paper feeding direction and releases a drive force transmission to the feed roller after the paper sheet is started to be transported by said transporting rollers.

7. The feeding device as claimed in claim 1, wherein said stop means includes a pulse encoder provided on an axis of the feed roller to detect a rotational angle of the feed roller.

8. A feeding device which feeds paper sheets in an image forming apparatus, comprising:

a paper supply tray detachable from a body of the image forming apparatus;

a feed roller having an exterior surface, said exterior surface includes at least one flat shaped portion having a friction coefficient lower than that of a remaining portion of the exterior surface;

an interlocking mechanism which induces paper sheets stacked in the paper supply tray to make pressure contact with said feed roller in conjunction with attachment of the paper supply tray to the body of the apparatus, and release the pressure contact between paper sheets and the feed roller in conjunction with detachment of the paper supply tray from the body of the apparatus; and stop means for stopping rotation of said feed roller in a state that said one flat shaped portion of the exterior surface of said feed roller contacts with an uppermost paper sheet whenever paper feeding is completed.

9. The feeding device as claimed in claim 8, wherein said feed roller is slidable in a direction in which the paper supply tray is drawn out of the body.

10. A feeding device which feeds paper sheets in an image forming apparatus, comprising:

a paper supply tray detachable from a body of the image forming apparatus;

a feed roller having on an exterior surface, at least one portion having a friction coefficient lower than that of a remaining portion of the exterior surface;

a pressure contact mechanism which induces paper sheets stacked in the paper supply tray to make pressure contact with said feed roller;

a pair of paper transporting rollers which are provided on a downstream side of the feed roller, and grip and transport a paper sheet fed by the feed roller;

a one-way clutch which is disposed on an axis of said feed roller and permits said feed roller to rotate in a paper feeding direction;

a motor which generates a drive force to rotate said feed roller; and a controller which stops the drive force to said feed roller in accordance with a timing sufficient to enable a paper sheet to be transported by said paper transporting rollers.

11. A feeding device as claimed in claim 10 further comprising an interlocking mechanism which operates said pressure contact mechanism in conjunction with attachment of the paper supply tray to the body of the apparatus, and releases the pressure contact between paper sheets and the feed roller in conjunction with detachment of the paper supply tray from the body of the apparatus.

12. The sheet feeding device as claimed in claim 10 further comprising a sensor, wherein said controller stops the drive force to said feed roller after a redetermined time from when a leading edge of a fed paper sheet is detected by said sensor.

13. The feeding device as claimed in claim 10, wherein said paper supply tray is detachably attached to the body in a direction perpendicular to a paper transporting direction, and said feed roller is slidable on its axis.

* * * * *